US005427257A

United States Patent [19]

Hanes et al.

[11] Patent Number: 5,427,257

[45] Date of Patent: Jun. 27, 1995

[54] DRAWBAR ASSEMBLY YOKE CASTING

[75] Inventors: Douglas M. Hanes, Pittsburgh; Jeffrey D. Wurzer, Glenshaw; Peter S. Mautino, Verona, all of Pa.

[73] Assignee: McConway & Torley Corporation, Pittsburgh, Pa.

[21] Appl. No.: 166,579

[22] Filed: Dec. 13, 1993

[51] Int. Cl.[6] ..... B61G 7/00

[52] U.S. Cl. ..... 213/67 R; 213/50; 213/50.5; 213/67 A

[58] Field of Search ..... 238/50, 50.5, 54, 56, 238/62 R, 67 A, 69, 70, 71, 72

[56] References Cited

U.S. PATENT DOCUMENTS

| | | | |
|---|---|---|---|
| 1,557,060 | 10/1925 | Kadel . | |
| 2,241,353 | 5/1941 | Kinnie et al. . | |
| 4,456,133 | 6/1984 | Altherr et al. | 213/62 R |
| 4,531,648 | 7/1985 | Paton . | |
| 4,555,033 | 11/1985 | Miller . | |
| 4,580,686 | 4/1986 | Elliott . | |
| 4,593,827 | 6/1986 | Altherr | 213/62 R |
| 4,700,853 | 10/1987 | Altherr et al. . | |
| 4,846,358 | 7/1989 | Rhen . | |
| 4,946,052 | 8/1990 | Kaim et al. . | |
| 5,035,338 | 7/1991 | Kaufhold et al. . | |
| 5,096,075 | 3/1992 | Glover | 213/62 R |
| 5,115,926 | 5/1992 | Kaufhold | 213/50 |
| 5,193,699 | 3/1993 | Kaufhold et al. | 213/62 R |
| 5,312,007 | 5/1994 | Kaufhold et al. | 213/50 |

*Primary Examiner*—Mark T. Le
*Attorney, Agent, or Firm*—James Ray & Associates

[57] ABSTRACT

An integral yoke member casting having a back wall portion, a first side wall portion formed integral with the back wall portion adjacent a first outer edge thereof. The first side wall portion has a front face portion which is engageable with a rear face portion of a front stop secured within a center sill member. A second side wall portion is formed integral with the back wall portion adjacent a second outer edge thereof. The second side wall portion includes a front face portion which is engageable with a rear face of another front stop secured within such center sill member. A top wall portion extends between inner surfaces of the first and second side wall portions and outwardly from such rear wall portion past the front faces of both the first and second side wall portions. There is a bottom wall portion which extends between such inner surfaces of such first and second side wall portions and outwardly from such rear wall portion past the front faces of both the first and second side wall portions. A first aperture is formed through the top wall portion and an axially opposed second aperture is formed through such bottom wall portion. A slot is formed through such bottom wall portion adjacent the inner surface of such rear wall portion for receiving at least a portion of a tapered wedge therein. A tapered wedge guide is disposed adjacent such rear wall portion for preventing lateral movement of such tapered wedge. A follower block guide is disposed adjacent such tapered wedge guide for maintaining such follower block in alignment with a butt end portion of a drawbar member.

20 Claims, 3 Drawing Sheets

DRAWBAR ASSEMBLY YOKE CASTING

CROSS REFERENCE TO RELATED APPLICATIONS

This patent application is closely related to a patent application titled "YOKE CASTING FOR A DRAWBAR ASSEMBLY" filed on Nov. 8, 1993 and accorded Ser. No. 08/148,379 and assigned to the assignee of the present invention. The above-referenced patent application is incorporated herein by reference thereto.

FIELD OF THE INVENTION

The present invention relates, in general, to a yoke member used in a slackless drawbar type system for connecting adjacently disposed ends of a pair of railway cars together, in a generally semipermanent manner and, more specifically, this invention relates to a yoke member which can be formed as an integral single piece casting for use in such slackless drawbar assembly.

BACKGROUND OF THE INVENTION

As is generally well known in the railroad art, the adjacently disposed ends of a pair of railway cars are connected together by various types of coupler arrangements. Such coupling arrangements may use either a conventional type coupler, an articulated type coupler or a drawbar.

A conventional type coupler is an independent unit disposed on an end of each car which interconnect with one another, between adjacent cars, to form a rather easily breakable type connection.

Both the drawbar assemblies and articulated type couplers, on the other hand, are integral type units. These units are adapted to extend between and be secured to the outer end of two adjacent cars to form a substantially semipermanent connection between such cars.

Nevertheless, in either coupling arrangement, a shank end of the coupler member, or the drawbar portion of a slackless drawbar assembly, will extend into the end of a center sill member of a railway car where it is secured so as to transmit the longitudinal forces being exerted to the car body during in-track service.

Prior to the present invention, certain other inventions have been directed to improvements in construction of the center sill member. These construction improvements in the center sill member have been for receiving primarily conventional type coupler members therein. However, these improvements may, also, have application in receiving coupling members of a slackless drawbar type system. By slackless, it is meant that the drawbar (or coupler member) is received within the end of such center sill member in a manner to minimize longitudinal play and/or other movements.

However, it is important for successive railway cars, which are connected together in a train consist, to be able to readily accommodate the relative movement which is encountered between cars when both curves and inclines are being negotiated. In other words, there must be provision made for each car to independently move in each of pitch, yaw and roll modes with respect to the coupler member.

Moreover, there must be some provision made to periodically remove the draft components for repair and/or the replacement of worn or broken parts and, in connection with a slackless drawbar type system, to disconnect connected cars.

Generally, in a slackless drawbar type system, the coupler member is held in such a manner so as to substantially eliminate, or to at least minimize, longitudinal movement with respect to the railway car body. This function may be accomplished, for example, by the provision of a tapered wedge member disposed between the inner surface of a rear wall portion of a pocket casting (secured in the center sill member) and a follower block member which is engageable with a surface located on both the tapered wedge member and the butt end portion of the coupler member.

During normal use, the tapered wedge member will tend to urge the follower block member in a direction away from the end wall portion of the pocket casting and firmly into engagement with the butt end portion of the drawbar member shank. When cars are being pushed, during operation, the longitudinal forces being exerted thereon will cause a compression of the butt end portion of such drawbar member against the follower block member, the tapered wedge member and the end wall portion of the pocket casting.

Conversely, when the railway cars are being pulled, the longitudinal forces being exerted which will tend to separate the drawbar member from the pocket casting are countered in at least some systems, conventional couplers, for example, by a draft key which is a metal bar that normally extends laterally of the car center sill member through aligned slots formed in the sidewall portions of the center sill member and a slot formed in the shank portion of the coupler member and in certain slackless drawbar type systems by a connecting pin member.

In a slackless drawbar system, the drawbar member is normally held tightly between the bearing block member and follower block member by operation of the tapered wedge member which separates the pocket casting and follower block member. Such tapered wedge member tries to compress the follower block member against the butt end portion of the drawbar thereby urging the latter against the bearing block member and the follower block member. In addition, as is known in the railroad art, the mating surfaces disposed on the follower block member and the butt end of such drawbar member are preferably curved to permit the drawbar to pivot slightly in each of a vertical and a lateral direction and to permit the car to roll with respect to the drawbar.

Prior to the present invention, the yoke members which were specifically designed for use only with such slackless drawbar type arrangements have generally been manufactured from a plurality of individual pieces. This makes the installation of the yoke member much more difficult. Furthermore, the use of separate pieces will normally tend to weaken the structure. This is obviously not a desirable condition in a railway application.

SUMMARY OF THE INVENTION

The present invention provides an integral single piece yoke member casting for connecting one end of a slackless drawbar member to a predetermined end of a railway car. Such drawbar member forms a part of a slackless drawbar connection arrangement that is used to connect adjacent predetermined ends of a pair of railway cars together, in a substantially semipermanent manner. This integral single piece yoke member casting includes a generally rectangular shaped back wall portion. The back wall portion has each of a substantially flat front and rear surface, a first predetermined width and a first predetermined height. There is a first vertically disposed generally rectangular shaped side wall portion formed integral with the back wall portion adjacent a first outer edge thereof. Such first side wall portion having each of a first predetermined length and the same first predetermined height of the rear wall portion. The first side wall portion includes a substantially flat front face portion which is engageable with at least a portion of a substantially flat rear face portion of a vertically disposed front stop member secured within a longitudinal opening of a center sill member attached to the underside of the car body. A second vertically disposed generally rectangular shaped side wall portion is, also, formed integrally with such rear wall portion adjacent a second outer edge thereof. The second side wall portion having a second predetermined length and the same first predetermined height of the rear wall portion. The second side wall portion also has a substantially flat front face portion which is engageable with at least a portion of a substantially flat rear face of another vertically disposed front stop member secured within such longitudinal opening of such center sill member. There is a horizontally disposed top wall portion which has a third predetermined length and extends between an inner surface of such first side wall portion and such second side wall portion as well as outwardly from an inner surface of such rear wall portion past the substantially flat front face of both the first side wall portion and the second side wall portion. An upper surface of the top wall portion is disposed in a first horizontal plane in which an upper surface of such rear wall portion is disposed. Further, a horizontally disposed bottom wall portion is provided which has a fourth predetermined length and extends between such inner surface of such first side wall portion and such second side wall portion as well as outwardly from the inner surface of such rear wall portion past the substantially flat front face of both such first side wall portion and such second side wall portion. The bottom surface of the bottom wall portion is disposed in a second horizontal plane in which a bottom surface of such rear wall is disposed. The third predetermined length of such top wall portion and the fourth predetermined length of such bottom wall portion are substantially longer than the first predetermined length of such first side wall portion and the second predetermined length of such second side wall portion. There is a first vertically disposed aperture, having a first predetermined diameter, formed through such top wall portion at a predetermined location and an axially opposed second vertically disposed aperture, having a second predetermined diameter, is formed through the bottom wall portion at a predetermined location. A generally rectangular slot means, having each of a predetermined length and a predetermined width, is formed through the bottom wall portion, adjacent such inner surface of the rear wall portion for receiving at least a portion of a tapered wedge member therein. Additionally, a tapered wedge member guide means is disposed adjacent the inner surface of such rear wall portion for preventing lateral movement of such tapered wedge member. A first portion of such tapered wedge member guide means extends outwardly from the inner surface of such first side wall portion and a second portion of such tapered wedge member guide means extends outwardly from the inner surface of such second side wall portion. Finally there is a follower block member guide means disposed adjacent such tapered wedge member guide means for maintaining such follower block member in alignment with a butt end portion of a drawbar member. A first portion of such follower block member guide means extends outwardly from the inner surface of such first side wall portion and a second portion of such follower block member guide means extends outwardly from the inner surface of such second side wall portion.

OBJECTS OF THE INVENTION

It is, therefore, one of the primary objects of the present invention to provide an improved yoke member for use in a slackless drawbar arrangement which can be manufactured as an integral single piece yoke member casting.

Another object of the present invention is to provide a yoke member casting, for use in a slackless drawbar system, which is relatively easy to install.

Still another object of the present invention is to provide a yoke member casting, useful in a slackless drawbar system, which will not separate when either buff or draft loads are being applied thereto by in-train actions encountered during service.

Yet another object of the present invention is to provide a yoke member casting, useful in a slackless drawbar system, which will normally require less maintenance.

A further object of the present invention is to provide a yoke member casting, useful in a slackless drawbar system, which is relatively light weight.

An additional object of the present invention is to provide a yoke member casting, useful in a slackless drawbar system, which can be readily retrofitted to existing slackless drawbar assemblies and to existing railway cars.

Still another object of the present invention is to provide a yoke member casting, for use in a slackless drawbar system, which will enable freer movement of the drawbar member secured within such yoke member casting.

In addition to the numerous objects and advantages of the integral single piece yoke casting which are described above, it should be understood that various other objects and advantages of the present invention will become more readily apparent, to those persons who are skilled in the railway coupler art, from the following more detailed description, particularly, when such description is taken in conjunction with the attached drawing Figures and, also, with the appended claims.

DESCRIPTION OF THE PREFERRED EMBODIMENTS OF THE INVENTION

Figure 1:
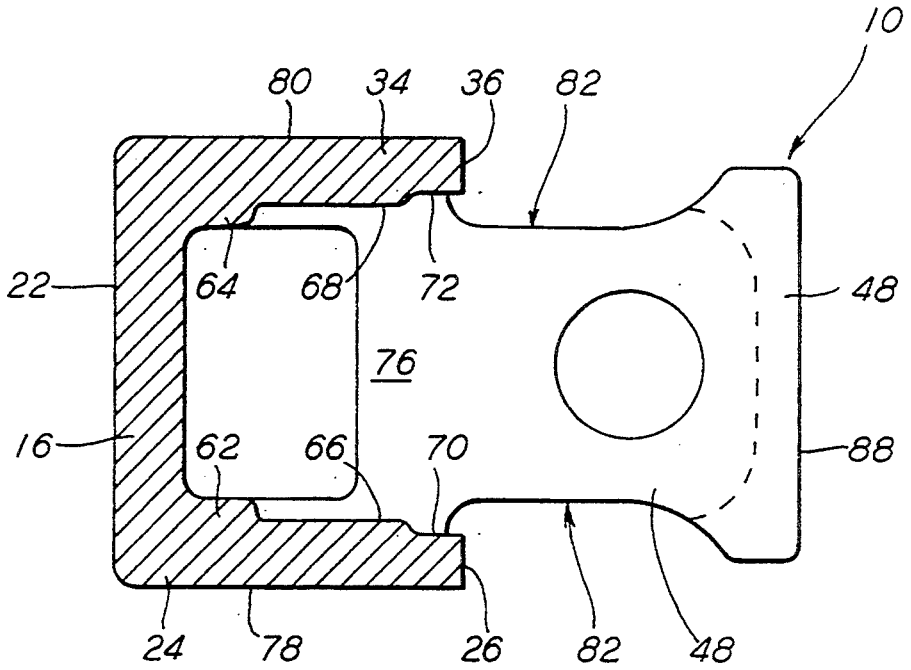
FIG. 1 is a top elevation view, partially in cross-section, which illustrates all of the essential elements of a presently preferred integral single piece yoke member casting, according to the presently preferred embodiment of the invention.

Prior to proceeding to the more detailed description of the integral single piece yoke casting, it should be noted that, for the sake of clarity, identical components, having identical functions, have been designated with identical reference numerals throughout the drawing Figures.

Figure 2:
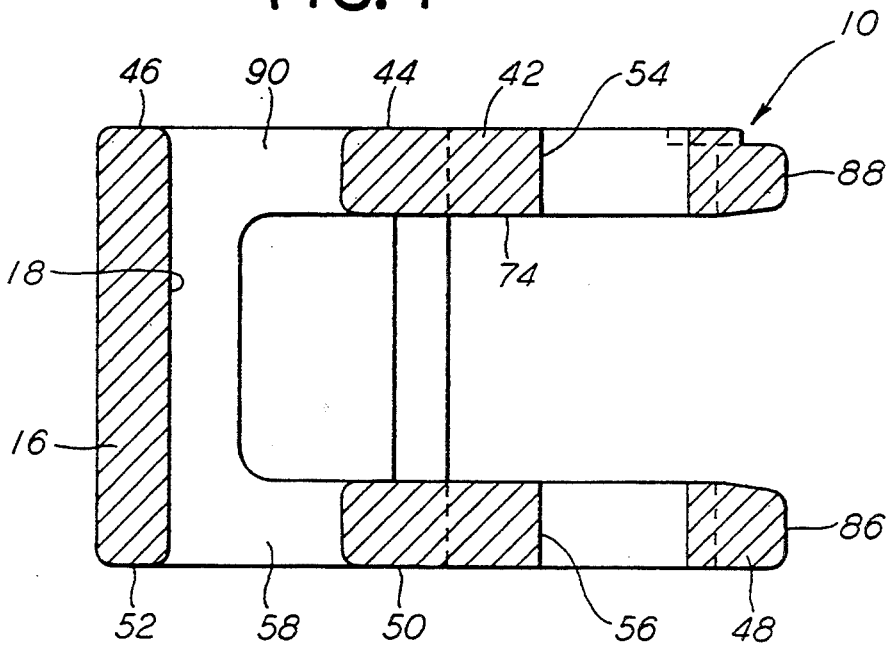
FIG. 2 is a view, partially in cross-section, taken along the lines II—II of FIG. 1 of the integral single piece yoke member casting.
Figure 3:
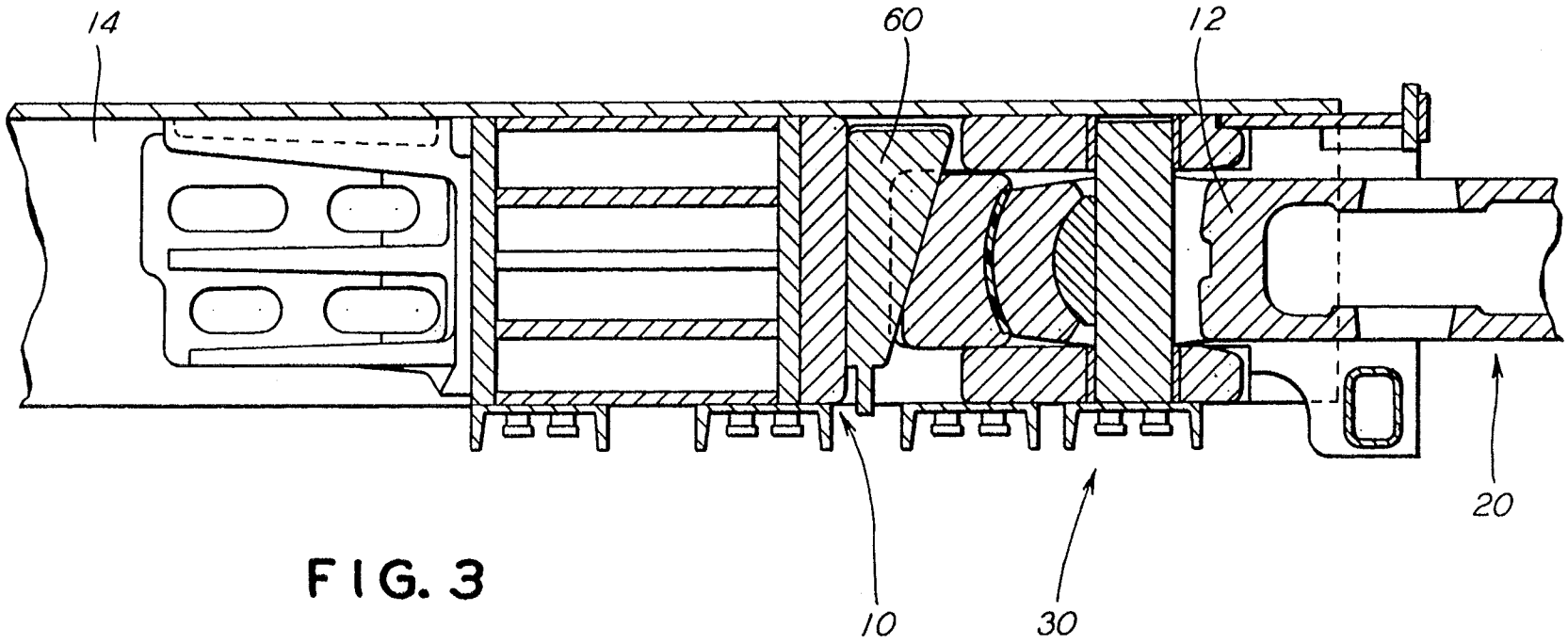
FIG. 3 is a side elevation view, partially in cross-section, which illustrates the use of the presently preferred yoke member casting in a slackless drawbar arrangement.
Figure 4:
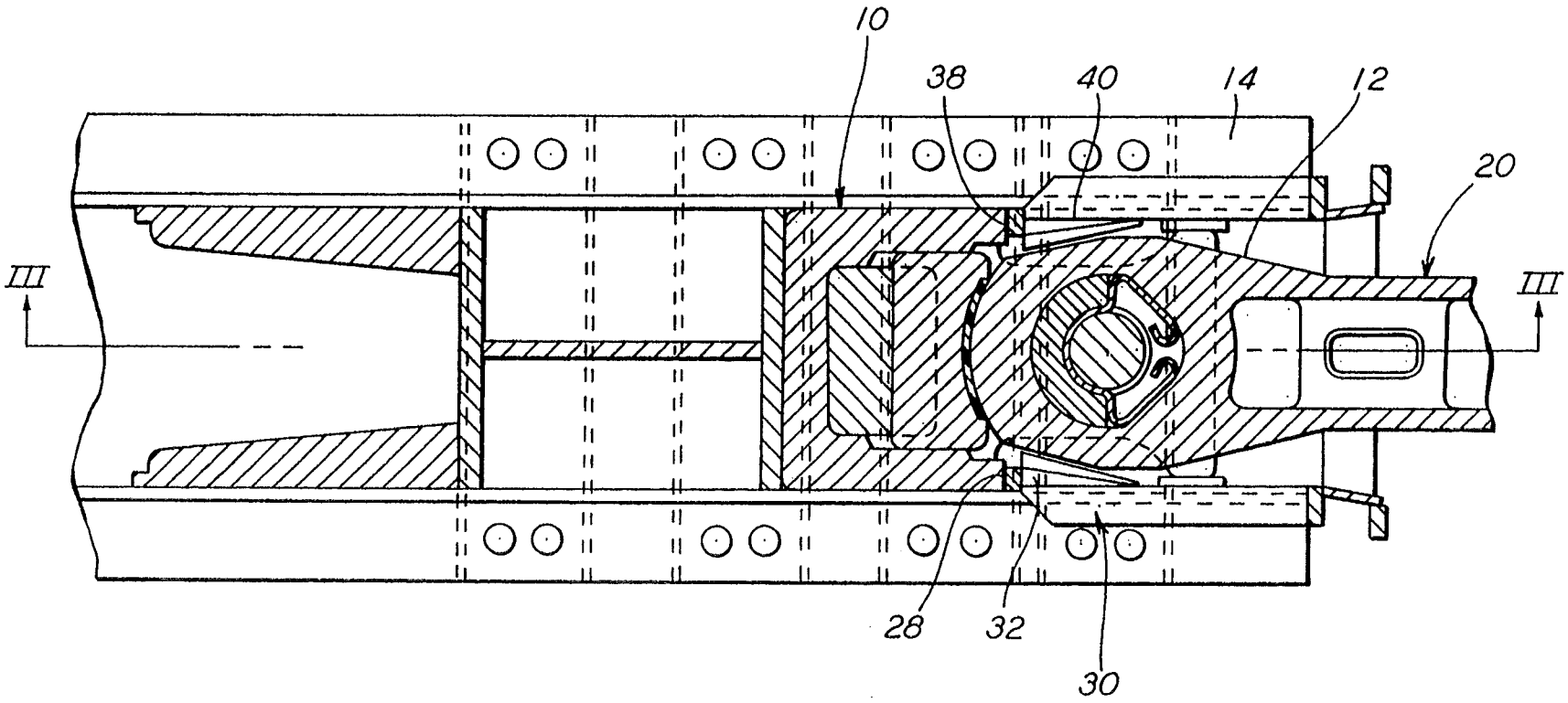
FIG. 4 is a top elevation view, partially in cross-section, taken along the lines III—III of FIG. 3.

Now refer, now particularly, to FIGS. 1 and 2. Illustrated therein, is an integral single piece yoke member casting, generally designated, 10 for connecting one end 12 (FIGS. 3 and 4) of a slackless drawbar, generally designated, 20 to a predetermined end of a center sill member 14 connected to a railway car (not shown) along a longitudinal centerline thereof.

Such drawbar 20 forms a part of a slackless drawbar connection arrangement, generally designated, 30. This slackless drawbar connection arrangement 30 is utilized, in the railway industry, to connect adjacent predetermined ends of a pair of such railway cars together, in a substantially semipermanent manner.

In the presently preferred embodiment of the invention, the integral single piece yoke member casting 10 includes a generally rectangular shaped back wall portion 16. Back wall portion 16 has both a substantially flat front or inner surface 18 and a rear or outer surface 22. Further, back wall portion 16 has a first predetermined width and a first predetermined height.

There is a first vertically disposed, generally rectangular shaped, side wall portion 24 formed integrally with such back wall portion 16 adjacent a first outer edge thereof. Such first side wall portion 24 has a first predetermined length and the same height as the height of such rear wall portion 16. First side wall portion 24 includes a substantially flat front face portion 26 which is engageable with at least a portion of a substantially flat rear face portion 28 of a vertically disposed front draft stop member 32 secured within a longitudinal opening of a center sill member 14. The height of such first side wall portion 24 closely corresponds to the height of an opening in such center sill member 14. Center sill member 14 is secured to a bottom portion (not shown) of a railway car body member. The first front stop member 32 is secured within the opening of such center sill member 14, preferably by welding.

The integral single piece yoke member casting 10 further includes a second vertically disposed side wall portion 34 formed integrally with the rear wall portion 16 adjacent an axially opposed outer edge thereof. The second side wall portion 34 has a second predetermined length and is generally rectangular in shape. A height of such second side wall portion 34 closely corresponds to the height of the opening in such center sill member 14. In addition, the second side wall portion 34 has a substantially flat front face portion 36 which is engageable with at least a portion of a rear face 38 (FIG. 3) of a second vertically disposed front stop member 40. The second front stop member 40 is, also, secured within the opening of the center sill member 14, preferably by welding.

There is a horizontally disposed top wall portion 42 which has a third predetermined length and extends between an inner surface of the first side wall portion 24 and the second side wall portion 34 and outwardly from the inner surface 18 of such rear wall portion 16 and past such flat front face 26 and 36, respectively, of both the first side wall portion 24 and such second side wall portion 36. An upper surface 44 of such top wall portion 42 is disposed in a first horizontal plane in which an upper surface 46 of the rear wall portion 16 is disposed.

Additionally, there is a horizontally disposed bottom wall portion 48, having a fourth predetermined length, which extends between such inner surface of such first side wall portion 24 and the second side wall portion 34 and outwardly from such inner surface 18 of the rear wall portion 16 past the substantially flat front faces 26 and 36, respectively, of both the first side wall portion 24 and the second side wall portion 34. A bottom surface 50 of the bottom wall portion 48 is disposed in a second horizontal plane in which a bottom surface 52 of the rear wall portion 16 is disposed. The third predetermined length of such top wall portion 42 and such fourth predetermined length of the bottom wall portion 48 being substantially longer than the first predetermined length of such first side wall portion 24 and such second predetermined length of the second side wall portion 34.

A first vertically disposed aperture 54, having a first predetermined diameter, is formed through such top wall portion 42 at a predetermined location and an axially opposed second vertically disposed aperture 56, having a second predetermined diameter, is formed through said bottom wall portion 48 at a predetermined location.

Yoke member casting 10 includes a generally rectangular slot means 58, having each of a predetermined length and a predetermined width, formed through such bottom wall portion 48 adjacent the inner surface 18 of such rear wall portion 16 for receiving at least a portion of a tapered wedge member 60 (FIG. 3) therein.

Further, a tapered wedge member guide means is disposed adjacent the inner surface 18 of such rear wall portion 16. This tapered wedge member guide means prevents any lateral movement of such tapered wedge member 60. A first portion 62 of such tapered wedge member guide means extends outwardly from such inner surface of the first side wall portion 24 and a second portion 64 of such tapered wedge member guide means extends outwardly from such inner surface of the second side wall portion 34.

The final essential element of the yoke member casting 10 of the present invention is a follower block member guide means disposed adjacent such tapered wedge member guide means for maintaining such follower block member in alignment with a butt end portion of a drawbar member. A first portion 66 of such follower block member guide means extends outwardly from such inner surface of the first side wall portion 24 and a second portion 68 of such follower block member guide means extends outwardly from the inner surface of such second side wall portion 34.

In the presently preferred embodiment of the invention, the first predetermined length of such first side wall portion 24 will be substantially identical to the second predetermined length of the second side wall portion 34. In addition, in this preferred embodiment, such third predetermined length of the top wall portion 42 will be substantially identical to such fourth predetermined length of the bottom wall portion 48.

It is, also, preferred that each of such third predetermined length of the top wall portion 42 and the fourth predetermined length of such bottom wall portion 48 will be at least two times as long as each of the first predetermined length of such first side wall portion 24 and the second predetermined length of such second side wall portion 34.

In the embodiment of the invention presently being described, the inner surface 70 of such first side wall portion 24 and the inner surface 72 of the second side wall portion 34 are disposed substantially parallel to each other. Furthermore, in the present invention, the bottom surface 74 of such top wall portion 42 will be disposed substantially parallel to the upper surface 76 of the bottom wall portion 48.

In the preferred embodiment, the upper surface 44 of the top wall portion 42 and the bottom surface 50 of such bottom wall portion 48 are disposed substantially parallel to one another. The outer surface 78 of such first side wall portion 24 and the outer surface 80 of the second side wall portion 34 are also disposed substantially parallel to each other.

It is clear from the above description that such outer surface 78 of the first side wall portion 24 and such outer surface 80 of the second side wall portion 34 in conjunction with the upper surface 44 of such top wall portion 42 and the bottom surface 50 of such bottom wall portion 48 form a generally rectangular shape. Such rectangular shape having a predetermined height and a predetermined width which closely correspond to a respective height and width of the longitudinal opening of such center sill member 14.

In the presently preferred embodiment of the invention, each outer edge of the top wall portion 42 includes a cutout portion 82, having a predetermined shape, said cutout portion begins rearwardly from a front edge 86 of the top wall portion 42 and ends closely adjacent said front face of a respective side wall portion 24 and 34.

Likewise, each outer edge of the bottom wall portion 48 includes a cutout portion 82, having a predetermined shape, preferably the same as the cutout portion of the top wall portion 42. Such cutout portion 82 begins rearwardly from a front face 86 of such bottom wall portion 48 and ends closely adjacent a front face of a respective side wall portion 24 and 34.

As best seen in FIG. 2, in order to ensure the requisite movement required of the drawbar 20, the bottom surface 74 of the top wall portion 42 is tapered downwardly, at a first predetermined angle, and inwardly from a front face portion 88 of such top wall portion 42 for a first predetermined distance. Also, the top surface 76 of the bottom wall portion 48 is tapered upwardly, at a second predetermined angle, and inwardly from the front face portion 86 of such bottom wall portion 48 for a second predetermined distance. Preferably, such first predetermined angle will be substantially .identical to such second predetermined angle and such first predetermined distance will be substantially identical to such second predetermined distance.

Preferably, such integral single piece yoke member casting 10 will be manufactured as a steel casting. Further it is within the scope of the present invention that certain areas of the yoke member casting 10 which will be subjected to wear may be hardened.

Further, such top wall portion 42 includes a generally rectangular slot 90 formed therethrough adjacent such rear wall portion 16. Normally, the slot 90 formed in such top wall portion 42 of such yoke member casting 10 is substantially identical to the slot 58 formed in such bottom wall portion 48.

Finally, in the presently preferred embodiment of the invention, the inner surface 62 of such first portion of such tapered wedge member guide means is substantially parallel to an inner surface 64 of the second portion of such tapered wedge member guide means and the inner surface 66 of the first portion of such follower block member guide means is substantially parallel to an inner surface 68 of the second portion of such follower block member guide means.

Although a number of presently preferred embodiments of the integral single piece yoke casting have been described in detail above, it should be understood that various modifications and adaptations of the instant invention may be made by persons skilled in the railroad coupling art without departing from the spirit and scope of the appended claims.

We claim:

1. An integral single piece yoke member casting utilized in connecting at least one end of a slackless drawbar member to a predetermined end of a railway car, such drawbar member forms a part of a slackless drawbar connection arrangement utilized to connect adjacently disposed ends of a pair of railway cars together, in a substantially semipermanent manner, said integral single piece yoke member casting comprising:

(a) a generally rectangular shaped back wall portion having each of a substantially flat front and rear surface, a first predetermined width and a first predetermined height;

(b) a first vertically disposed generally rectangular shaped side wall portion formed integral with said back wall portion adjacent a first outer edge thereof,said first side wall portion having a first predetermined length and said first predetermined height of said rear wall portion, said first side wall portion having a substantially flat front face portion which is engageable with at least a portion of a substantially flat rear face portion of a vertically disposed front stop member secured within a longitudinal opening of a center sill member;

(c) a second vertically disposed generally rectangular shaped side wall portion formed integral with said back wall portion adjacent a second outer edge thereof, said second side wall portion having a second predetermined length and said first predetermined height of said rear wall portion, said second side wall portion having a substantially flat front face portion which is engageable with at least a portion of a substantially flat rear face of another vertically disposed front stop member secured within such longitudinal opening of such center sill member;

(d) a horizontally disposed top wall portion having a third predetermined length and extending between an inner surface of said first side wall portion and said second side wall portion and outwardly from an inner surface of said rear wall portion past said substantially flat front face of both said first side wall portion and said second side wall portion, an upper surface of said top wall portion being disposed in a first horizontal plane in which an upper surface of said rear wall is disposed;

(e) a horizontally disposed bottom wall portion having a fourth predetermined length and extending between said inner surface of said first side wall portion and said second side wall portion and outwardly from said inner surface of said rear wall portion past said substantially flat front face of both said first side wall portion and said second side wall portion, a bottom surface of said bottom wall portion being disposed in a second horizontal plane in which a bottom surface of said rear wall is disposed, said third predetermined length of said top wall portion and said fourth predetermined length of said bottom wall portion being substantially longer than said first predetermined length of said first side wall portion and said second predetermined length of said second side wall portion;

(f) a first vertically disposed aperture, having a first predetermined diameter, formed through said top wall portion at a predetermined location;

(g) an axially opposed second vertically disposed aperture, having a second predetermined diameter, formed through said bottom wall portion at a predetermined location;

(h) a generally rectangular slot means having each of a predetermined length and a predetermined width formed through said bottom wall portion adjacent said inner surface of said rear wall portion for receiving at least a portion of a tapered wedge member therein;

(i) a tapered wedge member guide means disposed adjacent said inner surface of said rear wall portion for preventing lateral movement of such tapered wedge member, a first portion of said tapered wedge member guide means extending outwardly from said inner surface of said first side wall portion and a second portion of said tapered wedge member guide means extending outwardly from said inner surface of said second side wall portion; and (j) a follower block member guide means disposed adjacent said tapered wedge member guide means for maintaining such follower block member in alignment with a butt end portion of a drawbar member, a first portion of said follower block member guide means extending outwardly from said inner surface of said first side wall portion and a second portion of said follower block member guide means extending outwardly from said inner surface of said second side wall portion wherein said first portion of said tapered wedge member guide means, said first portion of said follower block member guide means and said inner surface of said first side wall portion are located on different vertical planes.

2. An integral single piece yoke member casting, according to claim 1, wherein said first predetermined length of said first side wall portion and said second predetermined length of said second side wall portion are substantially identical.

3. An integral single piece yoke member casting, according to claim 2, wherein said third predetermined length of said top wall portion and said fourth predetermined length of said bottom wall portion are substantially identical.

4. An integral single piece yoke member casting, according to claim 3, wherein said third predetermined length of said top wall portion and said fourth predetermined length of said bottom wall portion are at least twice as long as said first predetermined length of said first side wall portion and said second predetermined length of said second side wall portion.

5. An integral single piece yoke member casting, according to claim 1, wherein an inner surface of said first side wall portion and an inner surface of said second side wall portion are substantially parallel to one another.

6. An integral single piece yoke member casting, according to claim 5, wherein a bottom surface of said top wall portion and an upper surface of said bottom wall portion are substantially parallel to one another.

7. An integral single piece yoke member casting, according to claim 6, wherein an upper surface of said top wall portion and a bottom surface of said bottom wall portion are substantially parallel to one another.

8. An integral single piece yoke member casting, according to claim 7, wherein an outer surface of said first side wall portion and an outer surface of said second side wall portion are substantially parallel to one another.

9. An integral single piece yoke member casting, according to claim 8, wherein said outer surface of said first side wall portion, said outer surface of said second side wall portion, said upper surface of said top wall portion and said bottom surface of said bottom wall portion form a generally rectangular shape having a predetermined height and a predetermined width which closely corresponds to a height and a width of such longitudinal opening in such center sill member.

10. An integral single piece yoke member casting, according to claim 1, wherein each outer edge of said top wall portion includes a cutout portion having a predetermined shape, said cutout portion begins a predetermined distance rearwardly from a front edge of said top wall portion and ends closely adjacent said front face of a respective side wall portion.

11. An integral single piece yoke member casting, according to claim 10, wherein each outer edge of said bottom wall portion includes a cutout portion having a predetermined shape, said cutout portion begins a predetermined distance rearwardly from a front edge of said bottom wall portion and ends closely adjacent said front face of a respective side wall portion.

12. An integral single piece yoke member casting, according to claim 11, wherein a bottom surface of said top wall portion is tapered downwardly at a first predetermined angle and inwardly toward said longitudinal centerline from a front face portion of said top wall portion for a first predetermined distance.

13. An integral single piece yoke member casting, according to claim 12, wherein a top surface of said bottom wall portion is tapered upwardly at a second predetermined angle and inwardly toward said longitudinal centerline from a front face portion of said bottom wall portion for a second predetermined distance.

14. An integral single piece yoke member casting, according to claim 13, wherein said first predetermined angle and said second predetermined angle are substantially identical.

15. An integral single piece yoke member casting, according to claim 14, wherein said first predetermined distance and said second predetermined distance are substantially identical.

16. An integral single piece yoke member casting, according to claim 1, wherein said top wall portion further includes a generally rectangular slot formed therethrough adjacent said rear wall portion.

17. An integral single piece yoke member casting, according to claim 16, wherein said generally rectangular slot means comprises a generally rectangular slot adjacent said rear wall portion.

18. An integral single piece yoke member casting, according to claim 17, wherein said slot formed in said top wall portion of said yoke member casting is substantially identical to said slot formed in said bottom wall portion.

19. An integral single piece yoke member casting, according to claim 1, wherein said an inner surface of said first portion of said tapered wedge member guide means is substantially parallel to an inner surface of said second portion of said tapered wedge member guide means.

20. An integral single piece yoke member casting, according to claim 19, wherein said an inner surface of said first portion of said follower block member guide means is substantially parallel to an inner surface of said second portion of said follower block member guide means.

* * * * *